US007127924B1

(12) United States Patent
Ghiran

(10) Patent No.: US 7,127,924 B1
(45) Date of Patent: Oct. 31, 2006

(54) DOUBLE ACTION PUNCH ASSEMBLY FOR HYDROFORMING DIE

(75) Inventor: Mike M. Ghiran, Lake Orion, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/223,371

(22) Filed: Sep. 9, 2005

(51) Int. Cl.
*B21D 26/02* (2006.01)
*B21D 28/28* (2006.01)

(52) U.S. Cl. ..... 72/55; 72/58; 72/325; 72/370.27

(58) Field of Classification Search ..... 72/55, 72/325, 370.27, 58; 83/53, 54
See application file for complete search history.

(56) References Cited

U.S. PATENT DOCUMENTS 3,821,890 A * 7/1974 Dewey ..... 72/325
3,994,055 A * 11/1976 Maloney et al. ..... 29/890.14
5,881,992 A * 3/1999 Evertowski et al. ..... 248/674
6,305,201 B1 * 10/2001 Ghiran et al. ..... 72/55
6,470,546 B1 * 10/2002 Bonny et al. ..... 72/370.27
6,658,908 B1 * 12/2003 Ghiran et al. ..... 72/55
6,681,611 B1 * 1/2004 Haag et al. ..... 72/370.27
6,921,055 B1 * 7/2005 Schnabel et al. ..... 29/596

* cited by examiner

*Primary Examiner*—David Jones
(74) *Attorney, Agent, or Firm*—Laura C. Hargitt

(57) ABSTRACT

A double action punch assembly for a hydroforming die includes a first punch segment having an aperture extending therethrough. The double action punch assembly also includes a movable mounting block disposed in the aperture of the first punch segment. The double action punch assembly further includes a plurality of second punch segments connected to the mounting block. The first punch segment is moved in a first action to pierce a tubular member in a first direction and the second punch segments are moved in a second action to pierce the tubular member in a second direction to produce an opening in the tubular member.

18 Claims, 7 Drawing Sheets

DOUBLE ACTION PUNCH ASSEMBLY FOR HYDROFORMING DIE

TECHNICAL FIELD

The present invention relates generally to hydroforming and, more specifically, to a double action punch assembly for hydroforming die.

BACKGROUND OF THE INVENTION

It is known to form a cross-sectional profile of a tubular member by a hydro-forming process in which a fluid filled tubular blank is placed within a cavity of a die and then the die is closed so that the tubular blank is captured within the die. Fluid pressure is then increased inside the tubular member to expand the blank outwardly against the cavity of the die to provide a tubular product having a die formed cross-sectional profile.

During tube hydroforming, punches of various shapes are used to create necessary holes in the tube. The single body punches currently used, are adequate enough for creating holes, but, with some limitations. During piercing the only back support of the tube wall is the forming pressure. As an example, the low forming pressure of 7000 psi, used to form the majority of the tubular side rails, of the automotive frame, is not enough to hold the wall around the periphery of the hole from collapsing inward during piercing. A hole with such configuration makes it difficult to attach reinforcing parts, or any other parts, on the inside and/or in the immediate vicinity of the hole.

Methods of piercing holes using a double action punch have been designed, built, and proven. The first segment of the punch pierces the center part of the hole first, forming a rectangular hole. At the same time, it splits the slug in the center and folds it to the sides. The second segment of the punch starts to activate forward at the moment when the first segment reaches half stroke. The second segment of the punch is designed to shear two sides of the hole on a desired angle, preferably between 30 or 45 degrees, therefore applying more side force during cutting and minimizing the collapse of the hole edges. From this position on, both segments of the punch will travel together until the end of the predetermined stroke.

As the number of hydroformed tube applications grows, the need for complex piercing also increases. Tubes are not only designed with more holes, but also with larger, more sophisticated shapes, which in turn need more elaborate punch designs for piercing. The need to reduce secondary operations as well as improve quality is becoming more important. However, the methods currently used are not designed to pierce large holes in parts formed with low pressure. In order to reduce cost, the hydroforming industry is constantly searching for ways to reduce the need for laser or plasma cutting holes as a secondary operation and more ways for piercing all the necessary holes in the parts, during the hydroforming process.

The method currently used in piercing is conventional. Upon completion of hydroforming, the part is in intimate contact with the wall of the die. The hydroforming fluid is at the forming pressure, approximately 7,000 psi. A punch is attached to a hydraulic actuated cylinder. When the hydraulic cylinder is extended, the fluid pressure will support the tube around the circumference of the punch, allowing the metal to shear. The punch will shear a slug, which will fall as a loose piece and lay inside the formed tube, or in other situations, the tip of the punch will be provided with a 45 degree chamfer, allowing the slug to be retained on the edge of the hole.

As a result, it is desirable to provide a double action punch assembly to pierce holes in a tube during the hydroforming process. It is also desirable to provide a double action punch that can withstand extremely high forces. It is further desirable to provide a punch assembly that is more compact than a hydraulic cylinder of equal power. Therefore, there is a need in the art to provide a new double action punch assembly for a hydroforming die that meets these desires.

SUMMARY OF THE INVENTION

Accordingly, the present invention is a double action punch assembly for a hydroforming die including a first punch segment having an aperture extending therethrough. The double action punch assembly also includes a movable mounting block disposed in the aperture of the first punch segment. The double action punch assembly further includes a plurality of second punch segments connected to the mounting block. The first punch segment is moved in a first action to pierce a tubular member in a first direction and the second punch segments are moved in a second action to pierce the tubular member in a second direction to produce an opening in the tubular member.

One advantage of the present invention is that a double action punch assembly is provided for a hydroforming die that eliminates secondary piercing operations. Another advantage of the present invention is that the double action punch assembly provides a stronger, more robust product. Yet another advantage of the present invention is that the double action punch assembly results in a cost reduction for hydroforming.

Other features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
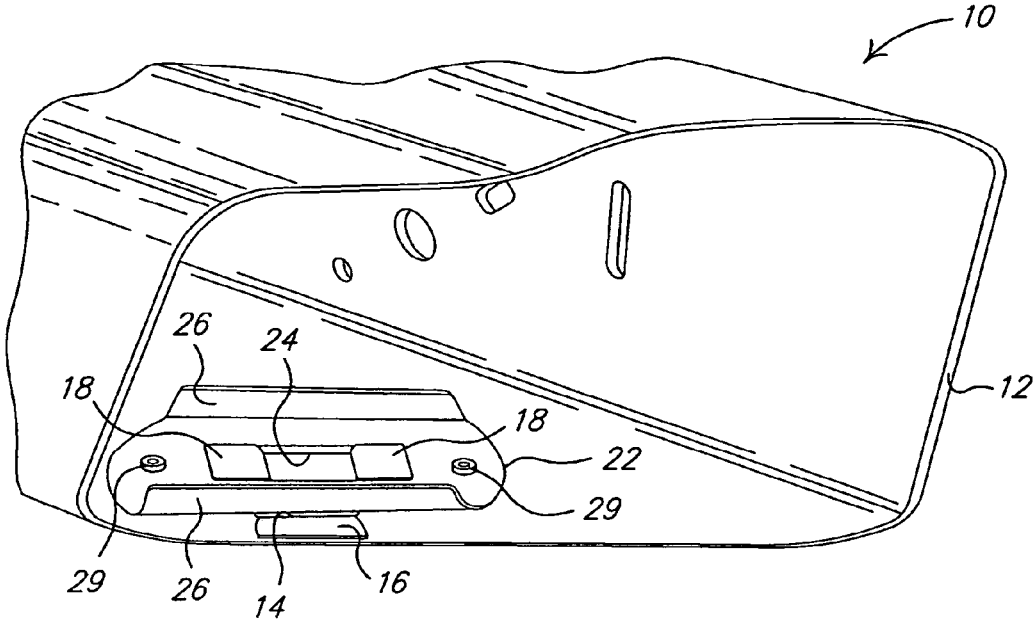
FIG. 1 is a perspective view of a hydroformed assembly.

Referring to the drawings and in particular FIG. 1, one embodiment of a hydroformed assembly 10 is shown. The hydroformed assembly 10 includes a hydroformed tubular member 12. The tubular member 12 extending longitudinally and has a generally rectangular cross-sectional shape. The tubular member 12 has an aperture 14 that is generally rectangular in shape. The tubular member 12 also has a pair of first tabs 16 extending from opposed sides of the aperture 14 and a pair of second tabs 18 extending from opposed sides of the aperture 14 for a function to be described. The tubular member 12 further includes a pair of apertures 20 extending therethrough. The apertures 20 are generally circular in shape. One of the apertures 20 is spaced from one of the second tabs 18. The tubular member 12 is made of a metal material.

The hydroformed assembly 10 also includes a reinforcing bracket 22 disposed over the aperture 14 and attached to the tubular member 12. The bracket 22 is generally rectangular in shape. The bracket 22 includes a central aperture 24 extending therethrough. The aperture 24 is generally rectangular in shape. The bracket 22 also has a pair of flanges 26 extending outwardly on opposed sides thereof. The bracket 22 further has a pair of apertures 28 extending therethrough. The apertures 28 are generally circular in shape. One of the apertures 28 is spaced from one of the flanges 26. The bracket 22 is made of a metal material.

The hydroformed assembly 10 includes at least one, preferably a plurality of fasteners 29 such as rivets to secure the bracket 22 to the tubular member 12. The fasteners 29 extend through the apertures 28 and 20 and the ends thereof are expanded to prevent the fasteners 29 from exiting the apertures 28 and 20. It should be appreciated that the fasteners 29 are conventional and known in the art.

Figure 2:
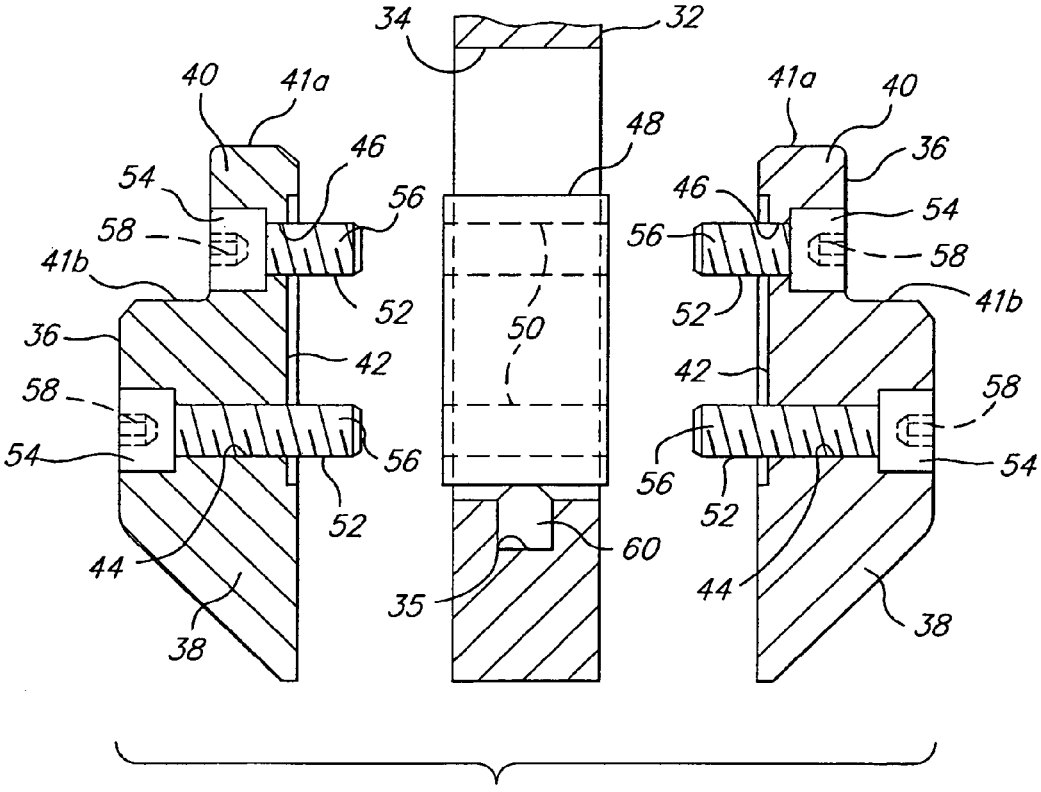
FIG. 2 is an exploded fragmentary elevational view of a double action punch assembly, according to the present invention, used for the hydroformed assembly of FIG. 1.
Figure 3:
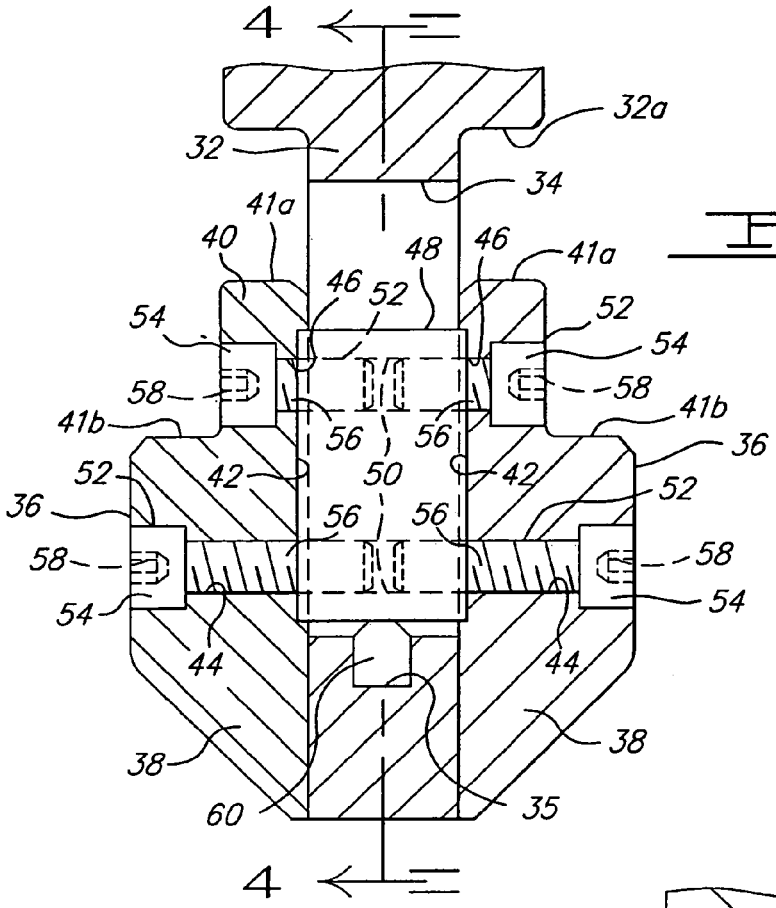
FIG. 3 is a fragmentary elevational view of the double action punch assembly of FIG. 2.
Figure 4:
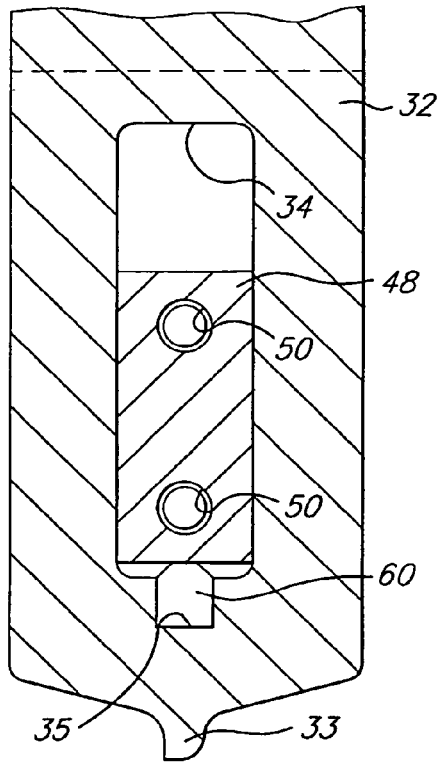
FIG. 4 is a sectional view taken along line 4—4 of FIG. 3.

Referring to FIGS. 2 through 4, a double action punch assembly 30, according to the present invention, is generally shown for forming the aperture 14 in the tubular member 12. The punch assembly 10 includes a first punch segment 32. The first punch segment 32 is generally rectangular in shape and has a shoulder 32*a*. The first punch segment 32 has a punch portion 33 of reduced thickness extending axially and at an approximately fifteen degree (15°) angle. The first punch segment 32 has an aperture 34 extending therethrough. The aperture 34 is generally rectangular in shape. The first punch segment 32 also has a recess or cavity 35 extending axially therein and communicating with the aperture 34. The first punch segment 32 is made of a metal material.

The punch assembly 10 also includes a pair of second punch segments 36 cooperating with the first punch segment 32. The second punch segments 36 are generally rectangular in shape. The second punch segments 36 have an inclined portion 38 at one end and a reduced portion 40 having a first shoulder 41*a* at the other end and a second shoulder 41*b* therebetween for a function to be described. The inclined portion 38 has an incline or angle of approximately forty-five degrees (45°). The second punch segments 36 have a recess 42 extending inwardly on one side thereof for a function to be described. The second punch segments 36 have a first aperture 44 extending therethrough and communicating with the recess 42 and a second aperture 46 extending through the reduced portion 40 and communicating with the recess 42. The second punch segments 36 are made of a metal material.

The punch assembly 20 includes a mounting block 48 cooperating with the first punch segment 32 and the second punch segments 36. The mounting block 48 is generally rectangular in shape. The mounting block 48 has a height greater than a width thereof. The mounting block 48 has a width greater than a width of the first punch segment 32. The mounting block 48 has a pair of apertures 50 spaced apart and extending therethrough. The mounting block 48 is made of a metal material.

The punch assembly 10 includes at least one, preferably a plurality of fasteners 52 to attach the first punch segment 32, second punch segments 36, and mounting block 48 together. The fasteners 52 have a head portion 54 extending radially and a threaded shaft portion 56 extending axially from the head portion 54. The head portion 54 has a recess 58 to allow a tool to be disposed therein to rotate the fastener 52. The head portion 30 has a diameter greater than a diameter of the shaft portion 32. The head portion 30 is disposed in the cavity 22 and the shaft portion 32 extends through the aperture 24. The assembly of the punch segments 32,36 is provided with clearance between the first punch segment 32 and the two second punch segments 36, therefore allowing the first punch segment 32 to travel unobstructed during piercing operation. It should be appreciated that the fasteners 52 are conventional and known in the art.

The punch assembly 10 may include a stop 60 to limit the travel of the mounting block 48 relative to the first punch segment 32. The stop 60 is generally cylindrical in shape. The stop 60 is disposed in the recess 35 in the first punch segment 32. The stop 60 has a length greater than a depth of the recess 35 to extend into the aperture 34 of the first punch segment 32. The stop 60 is made of an elastomeric material. It should be appreciated that the mounting block 48 is movable relative to the first punch segment 32. It should also be appreciated that the punch assembly 10 produces the large square opening 14 with four tabs 16,18 attached to be described.

Figure 5:
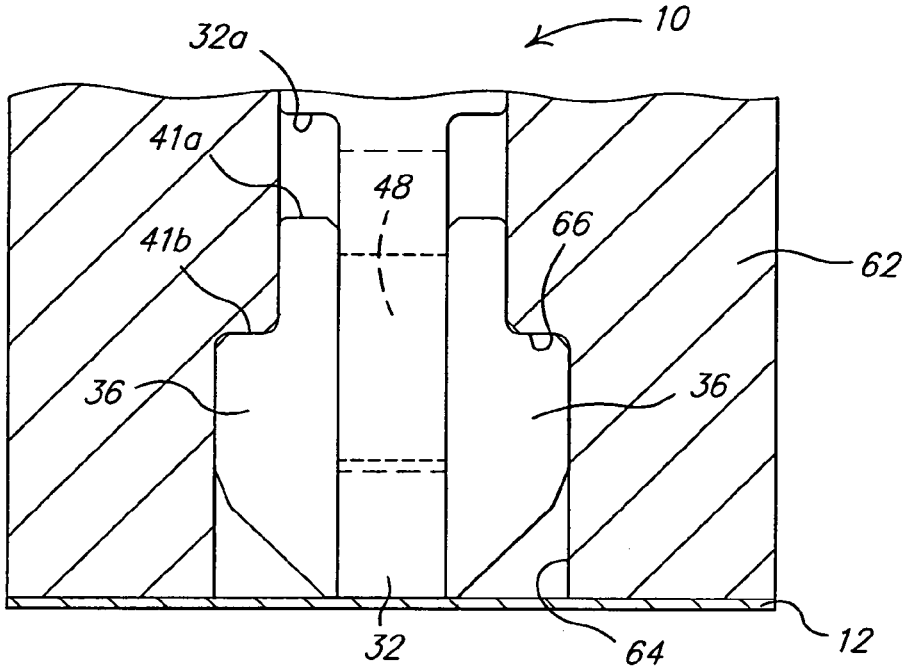
FIG. 5 is a fragmentary front elevational view of the double action punch assembly of FIG. 1 illustrating a first step of a hydroforming process.
Figure 6:
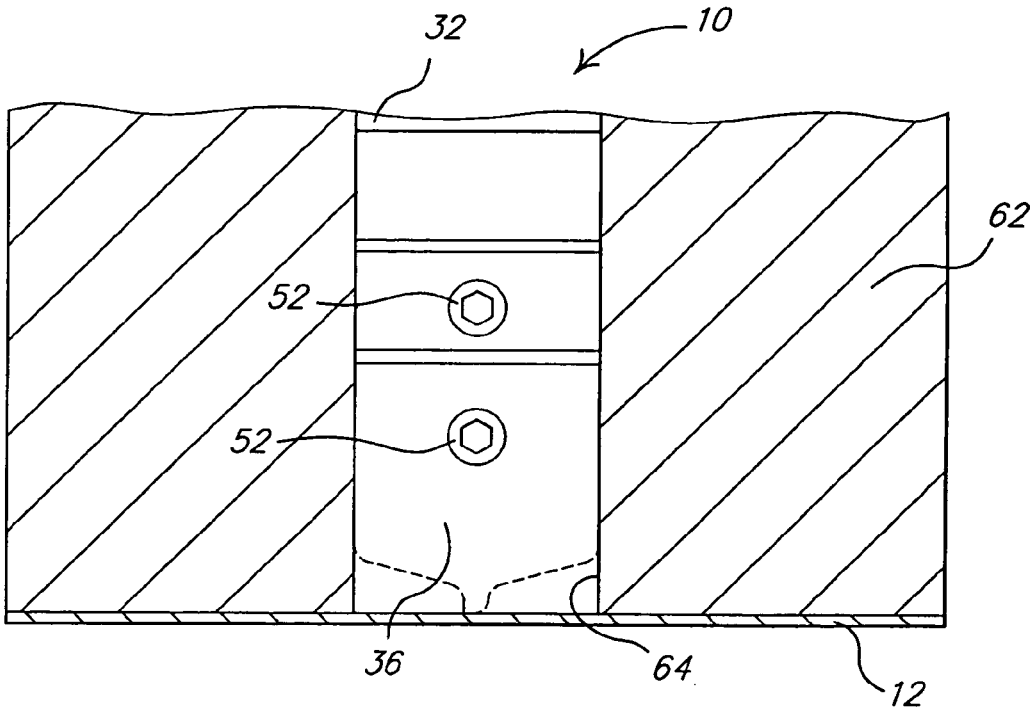
FIG. 6 is a fragmentary side elevational view of the double action punch assembly of FIG. 1 illustrating a first step of a hydroforming process.

Referring to FIGS. 5 through 12, the punch assembly 10 is supported upon a lower die half 62 of a die set (not shown). The lower die half 62 has a cavity 64 extending therein and the punch assembly 10 is disposed within the cavity 64 as illustrated in FIGS. 5 and 6. The lower die half 62 also has a shoulder 66 extending into the cavity 64 for cooperating with the second punch segments 36. It should be appreciated that the tubular member 12 rests against the lower die half 62 as illustrated in FIGS. 5 and 6.

Upon completion of hydroforming, the tubular member 12 is in intimate contact with a wall of the lower die half 62 and a surface area of the punch assembly 10. The hydroforming fluid 68 (indicated by the arrows in FIGS. 7 and 8) is pressurized to a forming pressure of approximately 7,000 psi. At this time, the tubular member 12 is formed and it will take the shape of a die cavity (not shown) by becoming in intimate contact with all the cavity surfaces including the surfaces of the first and second punch segments 32 and 36. It should be appreciated that the figures show only the lower die half 62 as well as an inside face of the tubular member 12.

Figure 7:
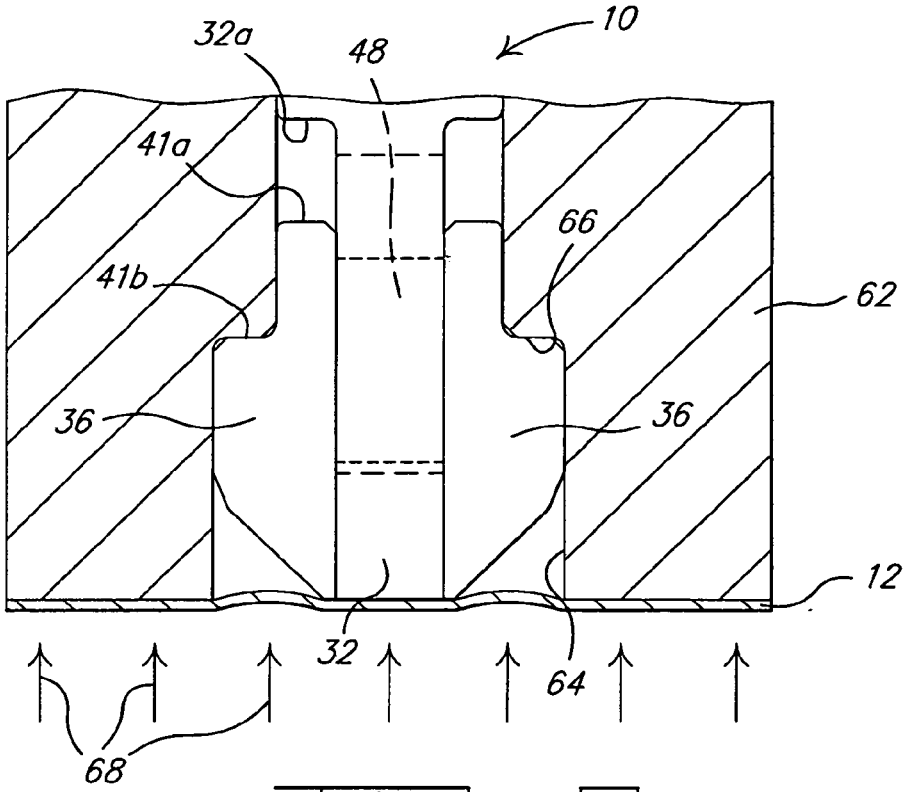
FIG. 7 is a view similar to FIG. 5 illustrating a second step of a hydroforming process.
Figure 8:
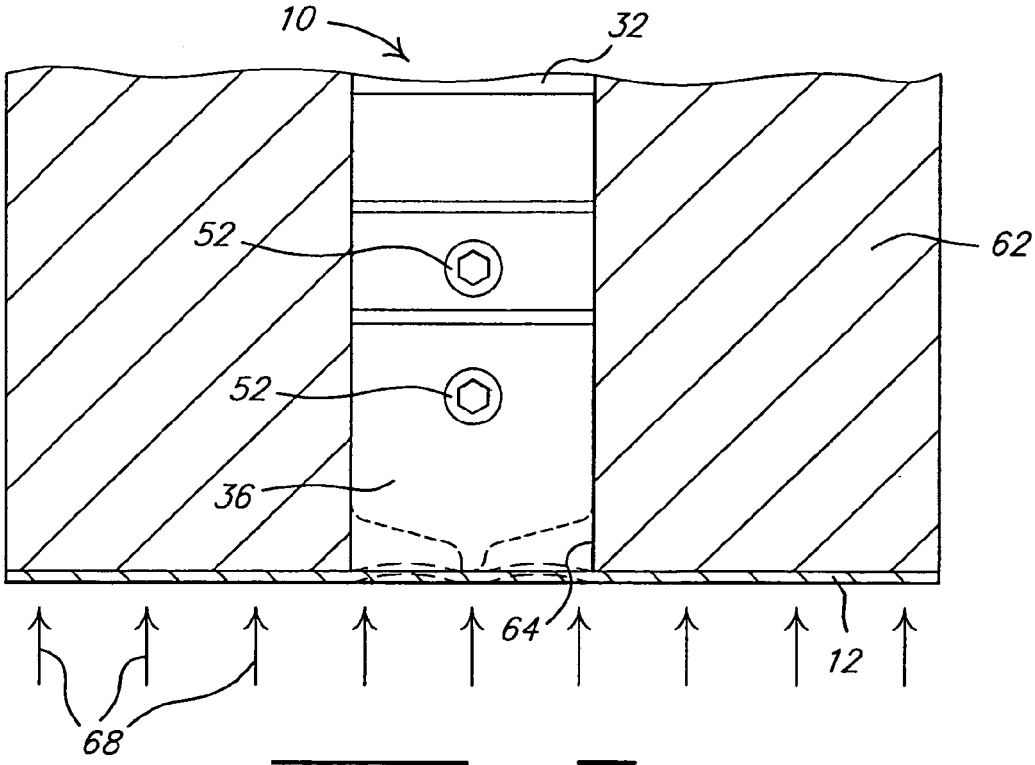
FIG. 8 is a view similar to FIG. 6 illustrating the second step of a hydroforming process.

During pressurization of the tubular member 12, the shoulder 41 of the second punch segments 36 is resting on the shoulder 66 of the lower die half 62. The first punch segment 32 is directly attached to a hydraulically actuated cylinder (not shown). When the hydraulic cylinder is advanced, the first punch segment 32 will advance first and slit the tubular member 12 as illustrated in FIGS. 7 and 8. After the wall of the tubular member 12 is split by the punch portion 33 at the front end of the first punch segment 32, the forward motion of the first punch segment 32 will shear both sides of the second tabs 18 and flip open.

Figure 9:
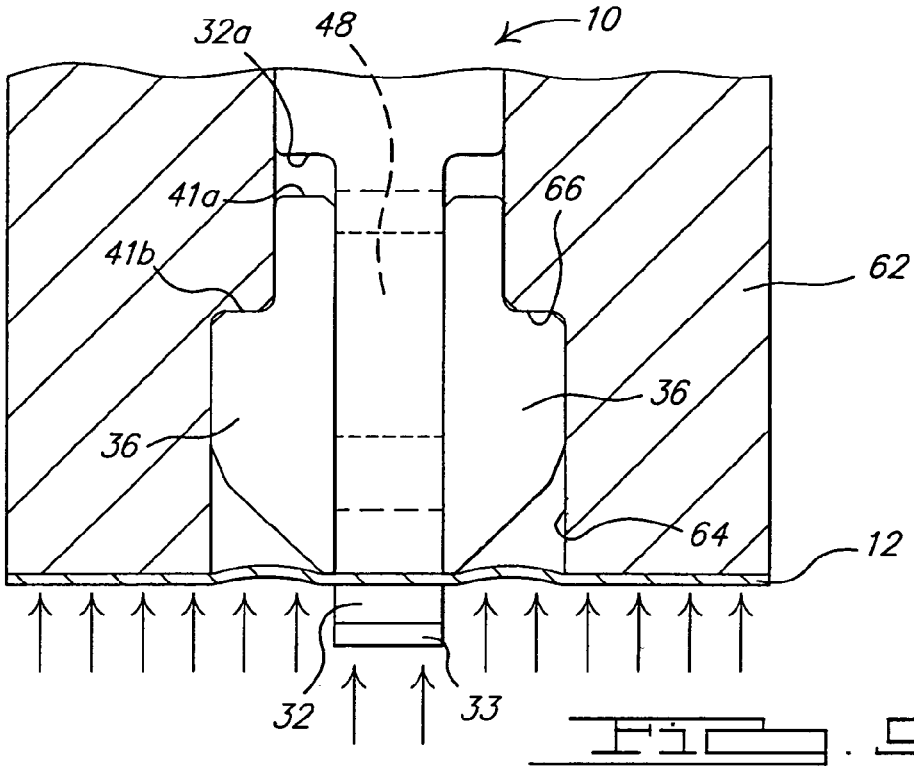
FIG. 9 is a view similar to FIG. 7 illustrating a third step of a hydroforming process.
Figure 10:
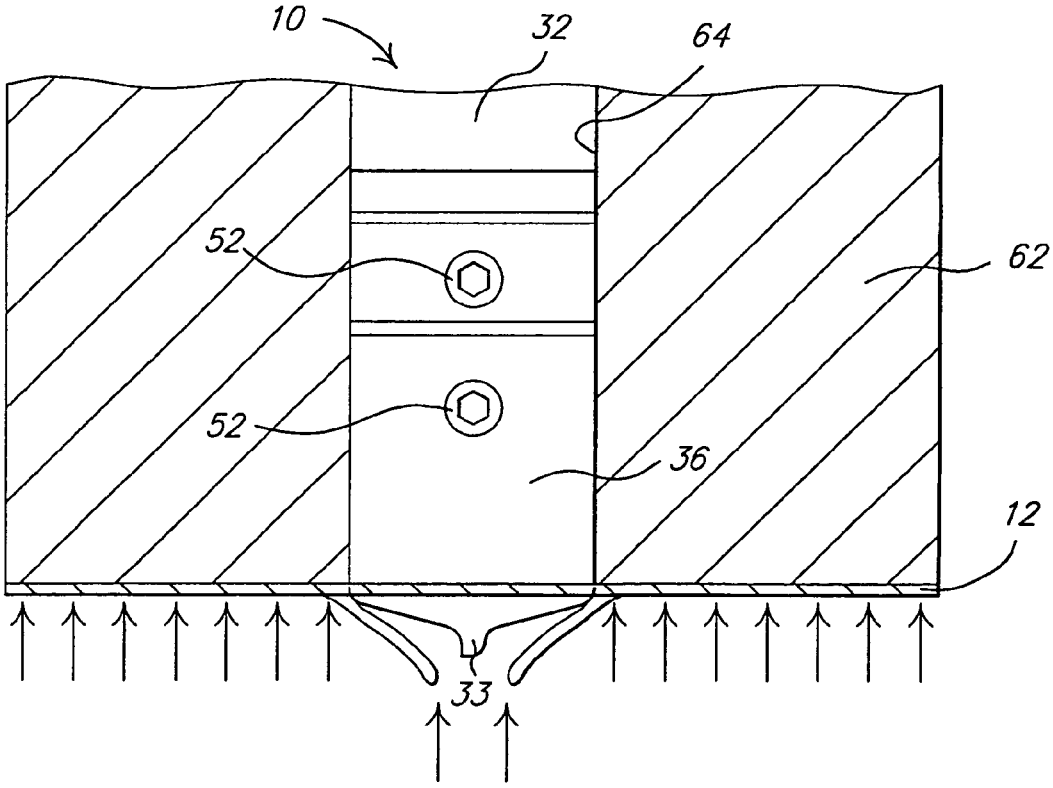
FIG. 10 is a view similar to FIG. 8 illustrating the third step of a hydroforming process.
Figure 11:
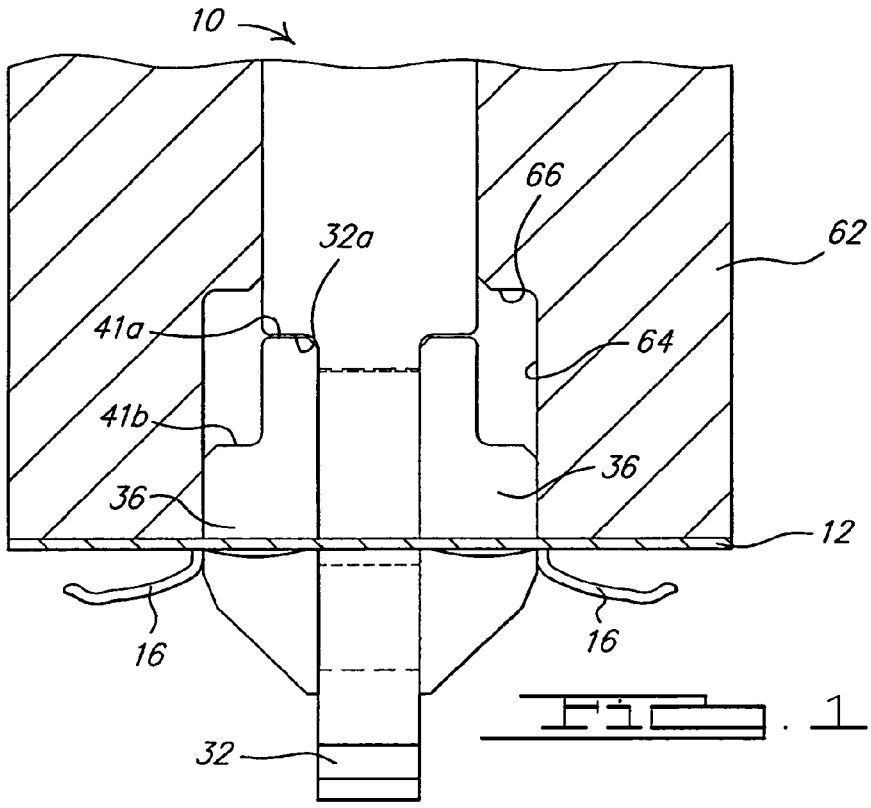
FIG. 11 is a view similar to FIG. 9 illustrating a fourth step of a hydroforming process.
Figure 12:
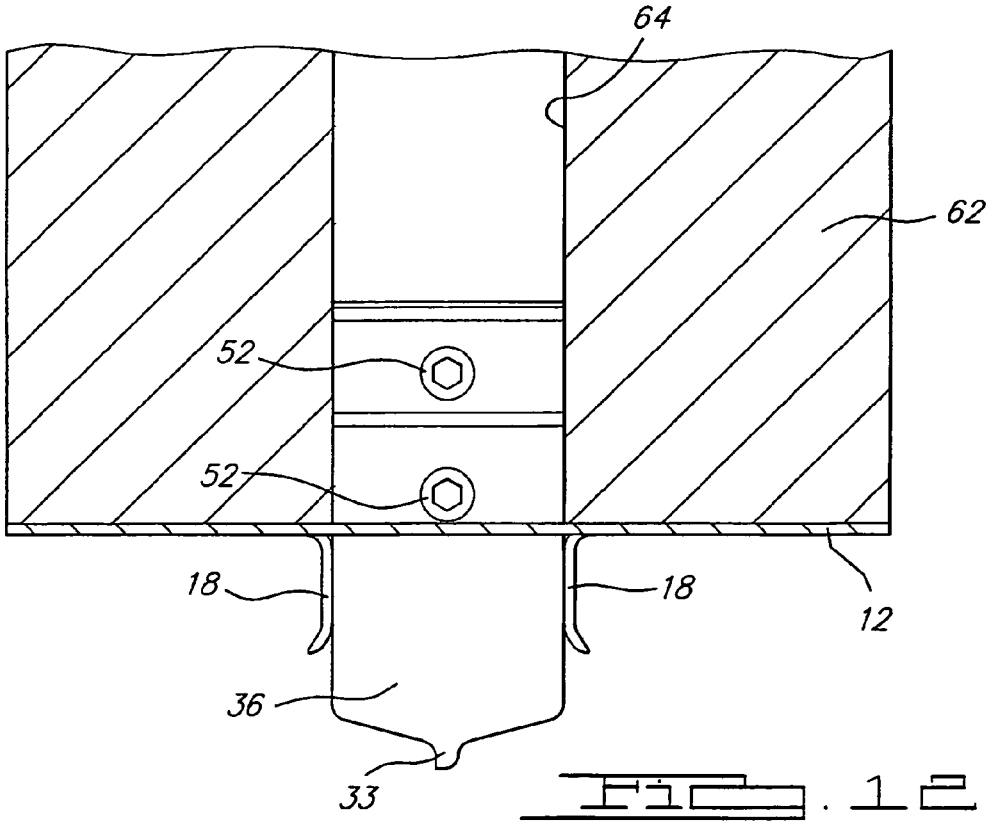
FIG. 12 is a view similar to FIG. 10 illustrating the fourth step of a hydroforming process.

During the forward motion of the first punch segment 32, the second punch segments 36 will be stationary until the shoulder 32*a* of the first punch segment 32 contacts the shoulder 41 of the second punch segments 36. After the shoulders 32*a* and 41 make contact, the second punch segments 36 will be carried forward by the first punch segment 32 and travel at the same speed, continuing the forward motion to the end of the predetermined stroke of the hydraulic cylinder. As the punch segments 32 and 36 continue the forward motion, the inclined portion 38 of the second punch segments 36 will start shearing the first tabs 16 as illustrated in FIGS. 9 and 10. At the end of the stroke, the first tabs 16 will be flipped away from the edge of the aperture 14, and the second tabs 18 will be perpendicular to the tubular member 12 as illustrated in FIGS. 11 and 12. It should be appreciated that first punch segment 32 is moved in a first action to pierce the tubular member 12 in a first direction and the second punch segments 36 are moved in a second action to pierce the tubular member 12 in a second direction to produce the opening 14 in the tubular member 12.

Figure 13:
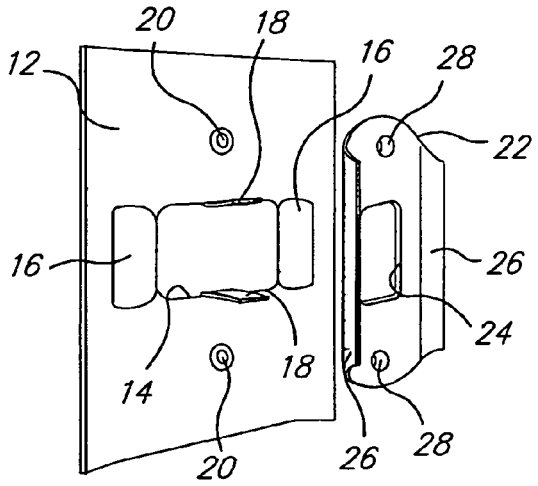
FIG. 13 is an exploded perspective view of a portion of the hydroformed tube and bracket of the hydroformed assembly of FIG. 1 illustrating a first step of assembly.
Figure 14:
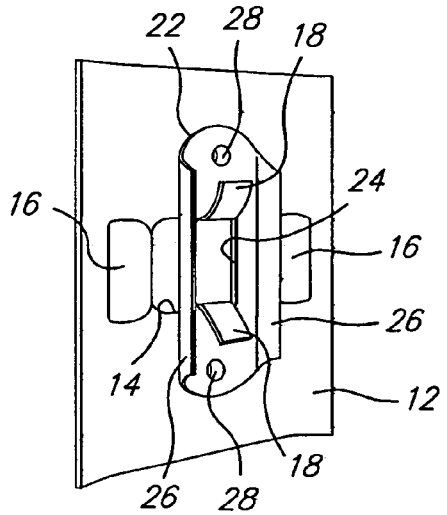
FIG. 14 is a perspective view of a portion of the hydroformed tube and bracket of the hydroformed assembly of FIG. 1 illustrating a second step of assembly.
Figure 15:
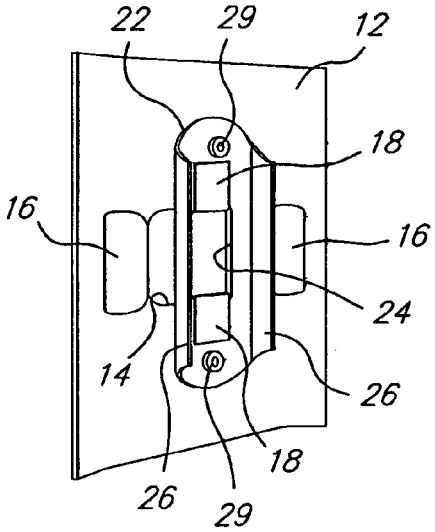
FIG. 15 is a perspective view of a portion of the hydroformed tube and bracket of the hydroformed assembly of FIG. 1 illustrating a third step of assembly.
Figure 16:
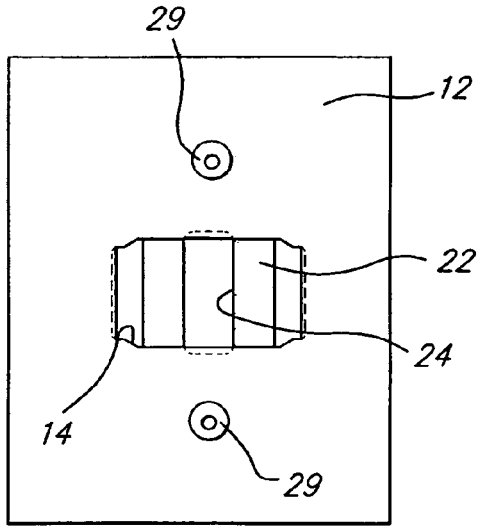
FIG. 16 is a perspective view of a portion of the hydroformed tube and bracket of the hydroformed assembly of FIG. 1 illustrating a fourth step of assembly.

Referring to FIGS. 13 through 16, the assembly of the hydroformed assembly 10 is shown. As illustrated in FIG. 13, the reinforcing bracket 22 is disposed over the aperture 14 of the tubular member 12. As illustrated in FIG. 14, the second tabs 18 extend through the aperture 24 in the reinforcing bracket 22 and are bent away from each other. The second tabs 18 are bent over the reinforcing bracket 22 as illustrated in FIG. 15. The reinforcing bracket 22 is then secured to the tubular member 12 by the fasteners 29 as illustrated in FIG. 16.

Accordingly, the punch assembly 10 of the present invention is designed to allow the piercing of large openings with minimum collapse in parts formed with relative low hydroforming pressure. This piercing punch assembly 10 will allow the mounting of reinforcing brackets 33 such as TieDown openings in hydroformed frames or other applications where the walls of the openings require no collapse.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A double action punch assembly for a hydroforming die comprising:

a first punch segment having an aperture extending therethrough;

a movable mounting block disposed in said aperture of said first punch segment; and a plurality of second punch segments connected to said mounting block, whereby said first punch segment is moved in a first action to pierce a tubular member in a first direction and said second punch segments are moved in a second action to pierce the tubular member in the first direction to produce an opening in the tubular member.

2. A double action punch assembly as set forth in claim 1 wherein said first punch segment has a punch portion at one end thereof of a reduced thickness.

3. A double action punch assembly as set forth in claim 1 wherein said first punch segment has a recess at one end of said aperture.

4. A double action punch assembly as set forth in claim 3 including a stop disposed in said recess and extending into said aperture to limit travel of said mounting block in said aperture.

5. A double action punch assembly as set forth in claim 1 wherein said second punch segments have an inclined portion at one end.

6. A double action punch assembly as set forth in claim 1 wherein said first punch segment includes at least one first shoulder formed thereon.

7. A double action punch assembly as set forth in claim 6 wherein each of said second punch portions have at least one second shoulder thereon to cooperate with said at least one first shoulder of said first punch segment.

8. A double action punch assembly as set forth in claim 1 including a plurality of fasteners to attach said second punch segments and said mounting block together.

9. A double action punch assembly as set forth in claim 8 wherein said mounting block has a width greater than a width of said aperture of said first punch segment.

10. A double action punch assembly as set forth in claim 1 wherein said mounting block has a height less than a height of said aperture of said first punch segment.

11. A hydroforming die assembly comprising:

a lower die half having a cavity extending axially therein;

a double action punch assembly operatively supported by said lower die half being moved in a first action to pierce a tubular member disposed adjacent said lower die half and moved in a second action to pierce the tubular member to produce an opening in the tubular member; and wherein said double action punch assembly comprises a first punch segment having an aperture extending therethrough, a movable mounting block disposed in said aperture of said first punch segment, and a plurality of second punch segments connected to said mounting block.

12. A method of forming an opening in a tubular member with a hydroforming die, said method comprising the steps of:

providing a hydroforming die;

providing a double action punch assembly;

supporting the double action punch assembly with the hydroforming die;

placing a tubular member adjacent the hydroforming die;

pressurizing the tubular member with hydroforming fluid;

moving the double action punch assembly relative to the tubular member in a first action to pierce the tubular member and moving the double action punch assembly in a second action to pierce the tubular member;

forming an opening in the tubular member; and wherein said step of providing a double action punch assembly comprises providing a fist punch segment having an aperture extending therethrough, a movable mounting block disposed in the aperture of the first punch segment, and a plurality of second punch segments connected to the mounting block.

13. A method as set forth in claim 12 including the step of advancing the first punch segment, slitting the tubular member, and shearing the tubular member to produce tabs on both sides thereof perpendicular to the tubular member.

14. A method as set forth in claim 13 including the step of contacting the second punch segments with the first punch segment and moving the second punch segments forward.

15. A method as set forth in claim 14 including the step of shearing the tubular member with the second punch segments to produce second tabs flipped away from the edge of the opening.

16. A hydroformed assembly comprising:

a hydroformed tubular member having a first aperture extending through one wall thereof, a pair of first tabs extending from first opposed sides of said aperture, and a pair of second tabs extending from second opposed sides of said aperture; and a reinforcing bracket disposed over said aperture and having a second aperture extending therethrough, wherein said second tabs extend trough said second aperture and are bent away from each other over said reinforcing bracket.

17. A hydroformed assembly as set forth in claim 16 wherein said first tabs are bent away from each other and said reinforcing bracket and over said tubular member.

18. A hydroformed assembly as set forth in claim 16 including at least one fastener to secure said reinforcing bracket to said tubular member.

* * * * *